US011534768B2

(12) United States Patent
Johansson et al.

(10) Patent No.: US 11,534,768 B2
(45) Date of Patent: Dec. 27, 2022

(54) GYRATORY CRUSHER TOPSHELL

(71) Applicant: SANDVIK SRP AB, Svedala (SE)

(72) Inventors: Jan Johansson, Lomma (SE); Michael Skog, Lund (SE); Sonny Ek, Svedala (SE); Magnus Fredriksson, Dalby (SE)

(73) Assignee: SANDVIK SRP AB, Svedala (SE)

( * ) Notice: Subject to any disclaimer, the term of this patent is extended or adjusted under 35 U.S.C. 154(b) by 154 days.

(21) Appl. No.: 16/965,542

(22) PCT Filed: Jan. 31, 2018

(86) PCT No.: PCT/EP2018/052444
§ 371 (c)(1),
(2) Date: Jul. 28, 2020

(87) PCT Pub. No.: WO2019/149357
PCT Pub. Date: Aug. 8, 2019

(65) Prior Publication Data

US 2021/0046483 A1 Feb. 18, 2021

(51) Int. Cl.

| | |
|---|---|
| ***B02C 2/04*** | (2006.01) |
| ***B02C 2/00*** | (2006.01) |
| ***B02C 2/06*** | (2006.01) |

(52) U.S. Cl.
CPC ..... *B02C 2/04* (2013.01); *B02C 2/00* (2013.01); *B02C 2/06* (2013.01)

(58) Field of Classification Search
CPC ..... B02C 2/04; B02C 2/00; B02C 2/06
See application file for complete search history.

(56) References Cited

U.S. PATENT DOCUMENTS

| | | | | |
|---|---|---|---|---|
| 4,034,922 | A | 7/1977 | Coxhill | |
| 10,434,516 | B2 * | 10/2019 | Hallberg | B02C 2/06 |
| 10,751,721 | B2 * | 8/2020 | Hallberg | B02C 2/06 |
| 2010/0155512 | A1 | 6/2010 | Persson et al. | |
| 2015/0053803 | A1 * | 2/2015 | Aberg | B02C 2/06 241/285.1 |
| 2015/0060584 | A1 | 3/2015 | Aberg et al. | |
| 2016/0067712 | A1 | 3/2016 | Christoffersson | |
| 2017/0304832 | A1 * | 10/2017 | Hallberg | B02C 2/045 |

FOREIGN PATENT DOCUMENTS

| | | | |
|---|---|---|---|
| EP | 2859949 | A1 | 4/2015 |
| WO | 2004110626 | A1 | 12/2004 |
| WO | 2017046437 | A1 | 3/2017 |

* cited by examiner

*Primary Examiner* — Faye Francis
(74) *Attorney, Agent, or Firm* — Corinne R. Gorski

(57) ABSTRACT

A gyratory crusher topshell having an annular shell wall that is strengthened to minimize stress concentrations and increase the topshell operational lifetime. The topshell includes spider arms that are structurally reinforced at their radially inner regions and also has an annular wall that is reinforced at regions immediately below the spider arms to further increase strength and facilitate casting.

13 Claims, 8 Drawing Sheets

GYRATORY CRUSHER TOPSHELL

RELATED APPLICATION DATA

This application is a § 371 National Stage Application of PCT International Application No. PCT/EP2018/052444 filed Jan. 31, 2018.

FIELD OF INVENTION

The present invention relates to a gyratory crusher topshell and in particular, although not exclusively, to a topshell having an annular wall reinforced against stress concentrations.

BACKGROUND ART

Gyratory crushers are used for crushing ore, mineral and rock material to smaller sizes. Typically, the crusher comprises a crushing head mounted upon an elongate main shaft. A first crushing shell (referred to as a mantle) is mounted on the crushing head and a second crushing shell (referred to as a concave) is mounted on a frame such that the first and second shells define together a crushing chamber through which the material to be crushed is passed. A driving device positioned at a lower region of the main shaft is configured to rotate an eccentric assembly positioned about the shaft to cause the crushing head to perform a gyratory pendulum movement and crush the material introduced in the crushing chamber.

The main shaft is supported at its uppermost end by a top bearing housed within a central hub that forms a part of a spider assembly positioned axially at an upper region of the topshell frame part. The spider arms project radially outward from the central hub to contact an axial upper flange or rim at the topshell. The material to be crushed typically falls through the region between the spider arms. Example gyratory crushers with topshell and spider assemblies are described in WO 2004/110626; US 2010/0155512; U.S. Pat. No. 4,034,922.

As will be appreciated, during use the topshell experiences considerable loading forces including torsion, compression and stress concentrations. Regions of high stress include the annular topshell wall below the spider arms and the radially inner region of the arms mounted at the central hub. As will be appreciated, large magnitude stress concentrations can lead to fatigue and cracking of the topshell and limit its operational lifetime. Additionally, conventional topshells typically require relatively complex pour feeder arrangements when casting the spider and topshell as a unitary component. Existing manufacturing methods are accordingly time consuming to prepare and undertake.

SUMMARY OF THE INVENTION

It is an objective of the present invention to provide a gyratory crusher topshell that greatly facilitates casting and that exhibits generally uniform mechanical strength characteristics in the circumferential direction around the annular wall of the topshell and in particular at those regions of the wall directly below the outer ends of the spider arms. It is a further objective to provide a topshell having spider arms that are reinforced at their radially inner ends that are coupled to the central hub.

It is a specific objective to provide a gyratory crusher topshell that simplifies the complexity of the pour feeder assembly that delivers the liquid melt into the mould during casting so as to reduce the time required for casting and potentially the number of feeders. It is a yet further specific objective to provide a topshell that is compatible with existing gyratory crusher bottomshells, concaves and main shafts so as to be capable of integration within existing gyratory crushers.

The objectives are achieved by providing a topshell in which mount bores (that receive clamp bolts to affix the concave in position within the topshell via an intermediate clamp ring), are positioned in a circumferential direction to either side of the spider arms such that the region directly below the radially outermost ends of the arms is formed by a reinforced wall region. Accordingly, loading forces are better transmitted from the spider arms into the topshell via the reinforced wall regions. Accordingly, the present topshell comprises an annular wall that may be considered to comprise a uniform radial wall thickness in a circumferential direction that is interrupted by recessed regions with each of these recessed regions corresponding in position (in the circumferential direction) to each of the mount bores to enable the mount bores to be inserted and removed at the topshell when securing the clamping ring in position. That is, in order to provide a uniform strength profile in a circumferential direction around the annular wall, the annular wall is reinforced in a circumferential direction between the mount bores so as to comprise a maximum possible radial thickness. As will be appreciated, a thickness of the reinforced wall regions is limited by the minimum internal diameter of the topshell and the radial position of attachment bores that are provided at an upper annular flange of the topshell to which a feed input hopper may be mounted via the attachment bores.

The objectives are further achieved by specifically configuring a width of the spider arms at their radially inner positions (in contact with the central hub) with respect to a plane aligned perpendicular to a longitudinal axis of the topshell. In particular, the spider arms taper outwardly in the perpendicular plane such that the cross sectional area of the arms increases in the radial direction towards the hub. In particular, a shape profile of these outward tapered regions is linear or convex (in the plane perpendicular to the longitudinal axis of the topshell). Such an arrangement is advantageous to minimise stress concentrations and increase the strength of the topshell to withstand the loading forces and in particular torque transmitted through the hub to the spider arms as the main shaft is rotated within the hub. The present configuration is particularly advantageous over conventional convex profiled transition regions (at the radially inner ends of the spider arms) that have been found to provide non-optimised load transfer and a limited resistance to stress concentrations at regions of the spider arms and at the junction between the spider arms and the hub and annular wall.

According to a first aspect of the present invention there is provided a gyratory crusher topshell comprising: an annular shell wall extending around the axis, the wall having a radially outward facing surface, a radially inward facing surface, an axial upper annular end and an axial lower annular end for mating with a bottomshell; a plurality of crushing shell mount bores extending axially through the wall towards the lower annular end to receive clamp bolts to mount a crusher shell within the topshell; characterised in that: a radial thickness of the annular wall at reinforced regions extending in the circumferential direction between and at an axial position of an axial upper end of the mount bores is greater than a radial thickness of the annular wall at a position of each mount bore in the circumferential direction.

Optionally, the topshell may further comprise: a spider having arms extending radially outward from a boss, positioned at a longitudinal axis extending through the topshell, to the axial upper annular end of the shell wall; and the mount bores are distributed in a circumferential direction around the annular wall being positioned at regions not axially below a central region in the circumferential direction of a radially outer end of each of the arms.

Preferably each of the reinforced regions extend in the circumferential direction continuously around a respective section of the topshell between the mount bores or the general positions or regions of the mount bores. Preferably, the radial thickness of the annular wall within each of the transition regions is generally uniform in the circumferential direction and/or in the axial direction. Such a configuration is advantageous to maximise the strength of the topshell and minimise the risk of porosity in the wall resultant from casting the topshell.

Preferably, the reinforced regions extend axially at least between the axial upper ends of the mount bores and an axial region immediately below the upper annular end of the wall. Accordingly, the reinforced regions extend substantially the full axial height of the topshell annular wall (below the spider arms) between the axial upper and lower ends. Optionally, the reinforced regions may extend exclusively between radially outward extending upper and lower flanges.

Preferably, the outward facing surface at the reinforced regions of the annular wall in a circumferential direction between the mount bores is positioned radially outside a radial position of each of the mount bores. Accordingly, the radial thickness of the annular wall at the reinforced regions is greater than the wall thickness at a position of each mount bore in a circumferential direction such that the mount bores are recessed to sit radially within the maximum wall thickness at the reinforced region between a radially outward and inward facing surface of the annular wall.

Optionally, a radial thickness of the annular wall at each recess (mount bore) may be in a range 10 to 70%, 20 to 60%, 20 to 40%, 30 to 60%, 35 to 55%, or 40 to 50% of a wall thickness at each reinforced region, at the same axial height position.

Preferably, the topshell further comprises an upper annular flange projecting radially outward from the outward facing surface of the annular wall at an axial position towards the upper annular end; and a lower annular flange projecting radially outward from the outward facing surface of the annular wall at an axial position towards the lower annular end, the lower annular flange comprising a plurality of bottomshell attachment bores, the attachment bores positioned radially outside the crushing shell mount bores.

Optionally, the topshell may further comprise respective sets of attachment bolts to secure the hopper and bottomshell to the topshell. The attachment bores are positioned radially outside the outward facing surface of the annular wall to avoid interference and contact with the annular wall.

Preferably, each of the arms comprise a pair of wings that project outwardly in a circumferential direction at a region where the arms meet the upper annular end of the wall, the mount bores positioned at regions not axially below the central region and the wings of the arms. Such a configuration is advantageous to maximise the cross sectional area of the arms at the transition region (in the axial direction) between the arms and the axial upper end of the annular wall of the topshell so as to minimise stress concentrations and maximise loading force transfer.

Preferably, the mount bores are positioned in a circumferential direction not axially below any portion of the arms. Such a configuration enables the annular wall to be reinforced directly below the radial outer portions of the arms to maximise loading force transfer between the spider and the annular wall (in particular to withstand torque forces). Such an arrangement is further advantageous to facilitate casting and reduce the likelihood of porosity within the arms and annular wall.

Preferably, the annular wall comprises a generally uniform radial thickness that is interrupted in a circumferential direction by radially recessed regions centred respectively on each of the mount bores wherein a wall thickness at the recessed regions is less than a wall thickness at the reinforced regions between the mount bores in a circumferential direction.

Preferably, a width of each of the arms in a plane perpendicular to the longitudinal axis and in a radially inward direction increases at respective transition regions of connection with the hub, wherein a shape of the transition regions in the plane perpendicular to the axis is a generally linear taper or is generally convex and the transition regions terminate at an outward facing surface of the hub. A convex shape profile has been found to particularly enhance the strength characteristics of the arms to be resistant to torsional loading forces. This increased the cross sectional area of the arms at the junction with the hub also facilitates casting and reduces the likelihood of porosity within the arms and hub.

Preferably, the width of each of the arms via each respective transition region increases continuously in the radially inward direction from a minimum width of each arm along a radial length portion of each arm, wherein said length portion is in the range 30 to 70%, 40 to 60%, or 45 to 55% of a total radial length of each arm as defined between a radially outermost surface of each arm positioned generally at the annular upper end of the wall and a radially innermost end of each arm corresponding to a radially innermost part of the respective transition region that interfaces with the radially outward facing surface of the hub. Such a configuration is beneficial to structurally reinforce the arms over a significant radial length portion in the immediate proximity of the central hub.

Preferably, a maximum width of each arm at a radially inner end of each transition region that interfaces with the radially outward facing surface of the hub is in the range 60 to 100%, 80 to 95%, or 84 to 92% greater than the minimum width of each arm in the plane perpendicular to the longitudinal axis. Such a configuration maximises the cross sectional area of the arms at the junction with the hub to minimise stress concentrations and maximise the efficient transfer of loading forces from the hub to the spider arms.

Preferably, each of the transition regions interface with the hub in the plane perpendicular to the longitudinal axis over an annular distance in a range 80 to 130°, 90 to 110° or 95 to 110°.

According to a second aspect of the present invention there is provided a gyratory crusher topshell comprising: a spider having arms extending radially outward from a boss positioned at a longitudinal axis extending through the topshell; an annular shell wall extending around the axis, the wall having a radially outward facing surface, a radially inward facing surface, an axial upper annular end from which the arms extend and an axial lower annular end for mating with a bottomshell; a plurality of crushing shell mount bores extending axially through the wall towards the lower annular end to receive clamp bolts to mount a crusher shell within the topshell; characterised in that: the mount bores are distributed in a circumferential direction around the annular wall being positioned at regions not axially below a central region in the circumferential direction of a radially outer end of each of the arms.

According to a third aspect of the present invention there is provided a gyratory crusher topshell comprising: a spider having arms extending radially outward from a boss positioned at a longitudinal axis extending through the topshell; an annular shell wall extending around the axis, the wall having a radially outward facing surface, a radially inward facing surface, an axial upper annular end from which the arms extend and an axial lower annular end for mating with a bottomshell; characterised in that: a width of each of the arms in a plane perpendicular to the longitudinal axis and in a radially inward direction increases at respective transition regions of connection with the hub, wherein a shape of the transition regions in the plane perpendicular to the axis is a generally linear taper or is generally convex and the transition regions terminate at an outward facing surface of the hub.

According to a fourth aspect of the present invention there is provided a gyratory crusher comprising a topshell as claimed herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
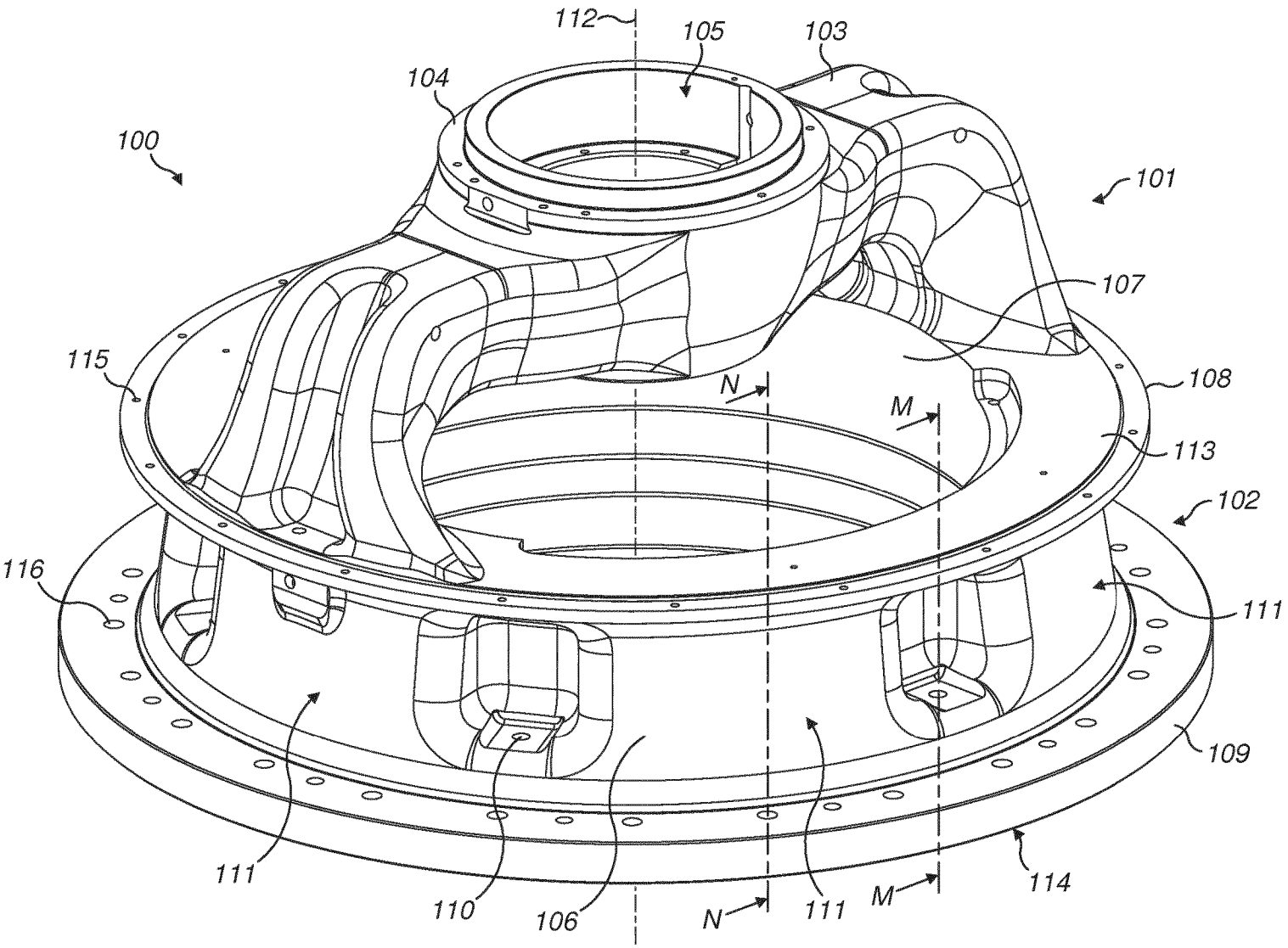
FIG. 1 is a perspective view of a gyratory crusher topshell according to a specific implementation of the present invention.
Figure 2:
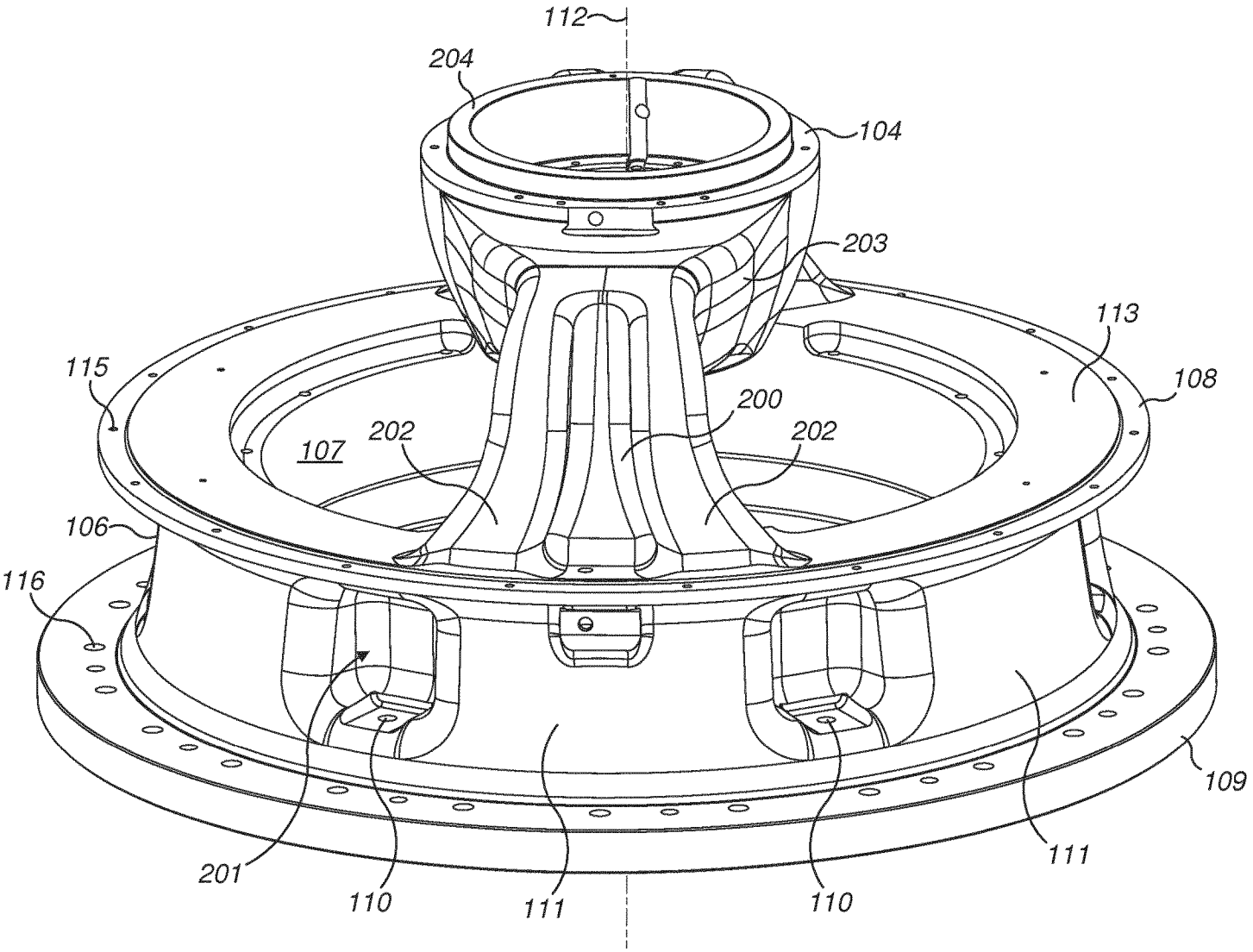
FIG. 2 is further perspective view of the topshell of FIG. 1.

Referring to FIGS. 1 and 2, the gyratory crusher topshell 100 comprises a spider indicated generally by reference 101 and an annular wall indicated generally by reference 102. Spider 101 comprises a pair of diametrically opposed arms 103 that project radially outward from a bowl shaped central hub 104 positioned on a longitudinal axis 112 extending through topshell 100. Each arm 103 is generally curved in the axial direction such that radially outer regions of each arm 103 extend axially to mate with an axial upper end of annular wall 102.

In particular, annular wall 102 comprises a first axial upper end defined by an axially upward facing planar annular face 113 and an axially lower annular end defined by a downward facing planar annular face 114. Wall 102 further comprises a radially outward facing surface 106 and a corresponding radially inward facing surface 107. An axially extending portion of surface 107 is generally cylindrical and is concentric with a radially inward facing surface of hub 104 that defines a central bore 105 that mounts rotatably a main shaft (not shown) of the gyratory crusher via an axially upper main shaft bearing assembly (not shown) as will be appreciated by those skilled in the art. Topshell 100 via radially inward facing surface 107 is configured to mount and positionally support an outer crushing shell (alternatively termed a concave) (not shown) in substantially fixed position to define one half of a crushing zone that is further defined by an inner crushing shell (alternatively termed a mantle) (not shown) supported on a crusher head (not shown) mounted in turn on the crusher main shaft. An axially upper annular flange 108 projects radially outward at an axial position corresponding approximately to upper end annular face 113 of wall 102. A corresponding lower annular flange 109 projects radially outward from the outward facing surface 106 of wall 102 at the lower end of the wall 102 positioned approximately at lower end annular face 114. Annular wall 102 extends axially between the upper and lower flanges 108, 109. According to the specific implementation, radially outward facing surface 106 comprises a generally frusto-conical shape profile being inclined radially inward towards at the axial upper end relative to the axial lower end of wall 102. Such a configuration is beneficial for casting of the topshell 100 to minimise porosity within the wall 102 and the spider arms 103.

A plurality of hopper attachment bores 115 are distributed circumferentially and extend axially through flange 108 being configured to receive attachment bolts to mount a feed hopper (not shown) to topshell 100. A corresponding set of bottomshell attachment bores 116 are distributed circumferentially around and extend axially through lower flange 109 to receive attachment bolts to mount a bottomshell (not shown) below topshell 100 so as to define the main frame of the gyratory crusher.

Figure 6:
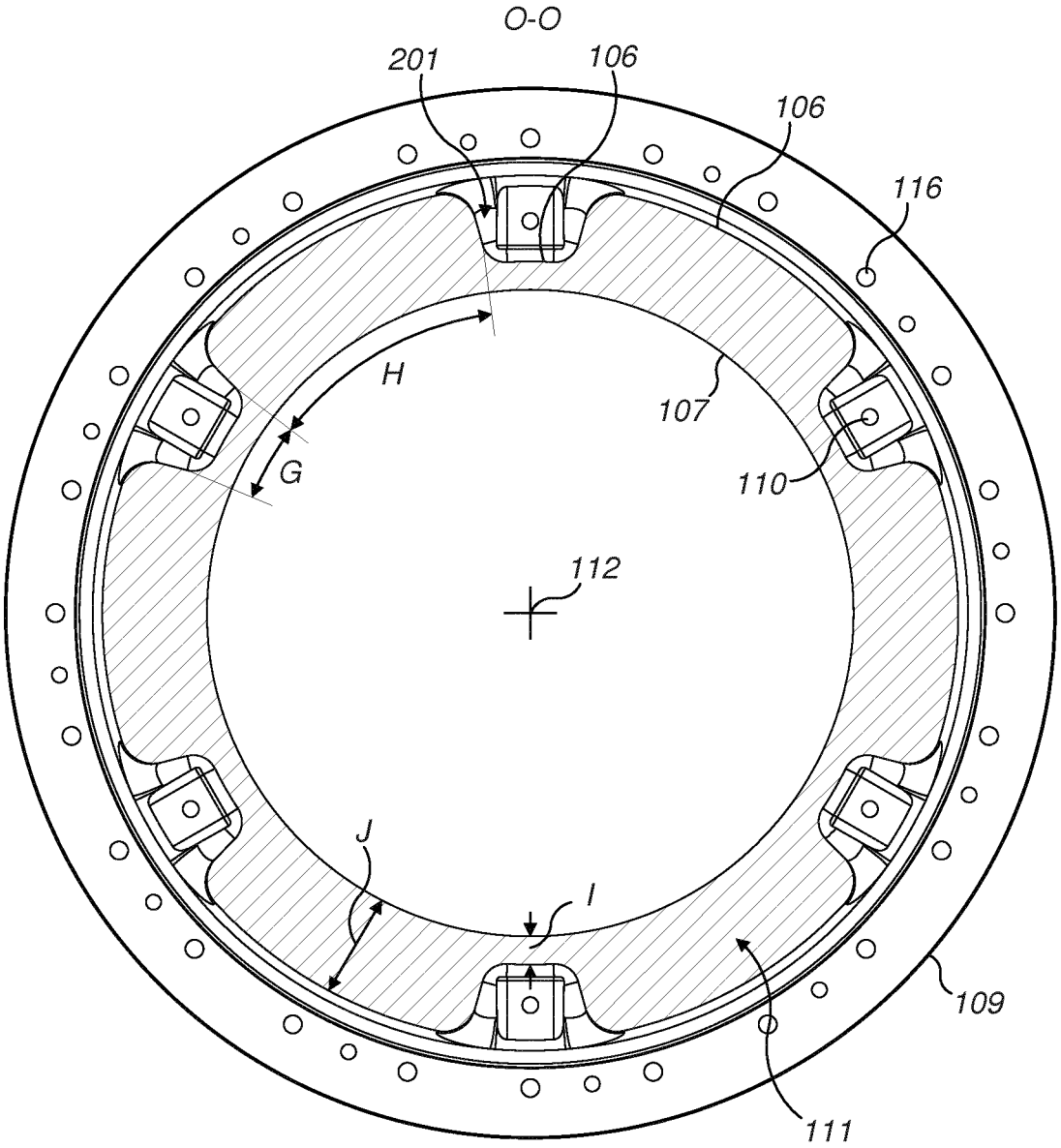
FIG. 6 is a plan cross sectional view through O-O of the topshell of FIG. 3.

Annular wall 102 comprises reinforced regions indicated generally by reference 111 that extend in a circumferential direction between each of a plurality of mount bores 110 that extend axially through wall 102. A radial wall thickness of wall 102 at the reinforced regions 111 is greater than a corresponding wall thickness of wall 102 at the circumferential positions corresponding to the location of each mount bore 110. Accordingly, an axial upper end of each mount bore 110 (positioned axially within the region of wall 102 axially between upper and lower flanges 108 and 109) is accommodated within a recess indicated generally by reference 201. Each recess 201 projects radially inwardly from the outward facing surface 106 of wall 102 towards radially inward facing surface 107 so as to define a set of pockets or cavity regions distributed circumferentially around wall 102. Each recess 201 extends the full axial height of wall 102 between upper and lower flanges 108, 109. Additionally, a width of each recess 201 in a circumferential direction is sufficient to accommodate a bolt head and to allow a suitable attachment tool (such as a wrench or the like) to be inserted within recess 201 to engage the bolt head to provide fastening or unfastening of the topshell 100 and the bottomshell. The width of each recess 201 in a circumferential direction is less than a corresponding distance over which each of the reinforced regions 111 extends around axis 112. In particular a width (in a circumferential direction) of each recess 201 is approximately 50% or less than 50% of the length in the circumferential direction of each reinforced region 111. Accordingly, the majority of annular wall 102 is reinforced. Referring to FIG. 6, a radial distance G over which each recess 201 extends is in a range 30 to 40% of the angular distance H in a circumferential direction over which each reinforced region 111 extends. Additionally, a corresponding radial thickness at an axial mid-height position of annular wall 102 (axially between flanges 108 and 109) is substantially greater at each reinforced region 111 than at each recessed region 201. In particular, and referring to FIGS. 3 and 4, a radial thickness I of annular wall 102 at each recess 201 is in a range 25 to 35% of a wall thickness J at each reinforced region 111 (at the same axial height position). According to further specific implementations, the radial thickness I of annular wall 102 at each recess 201 may be in a range 40 to 50% of a wall thickness J at each reinforced region 111.

As will be noted from FIGS. 1, 2 and 6, each mount bore 110 is positioned radially inside the set of bottomshell attachment bores 116 so as to extend from each recess 201 to the downward facing lower end annular face 114 of topshell 100. Accordingly, an axial length of each mount bore 110, between an axial upper end 110*a* and an axial lower end 110*b*, is greater than a corresponding axial length of each bottomshell attachment bore 116 and hopper attachment bore 115.

Figure 3:
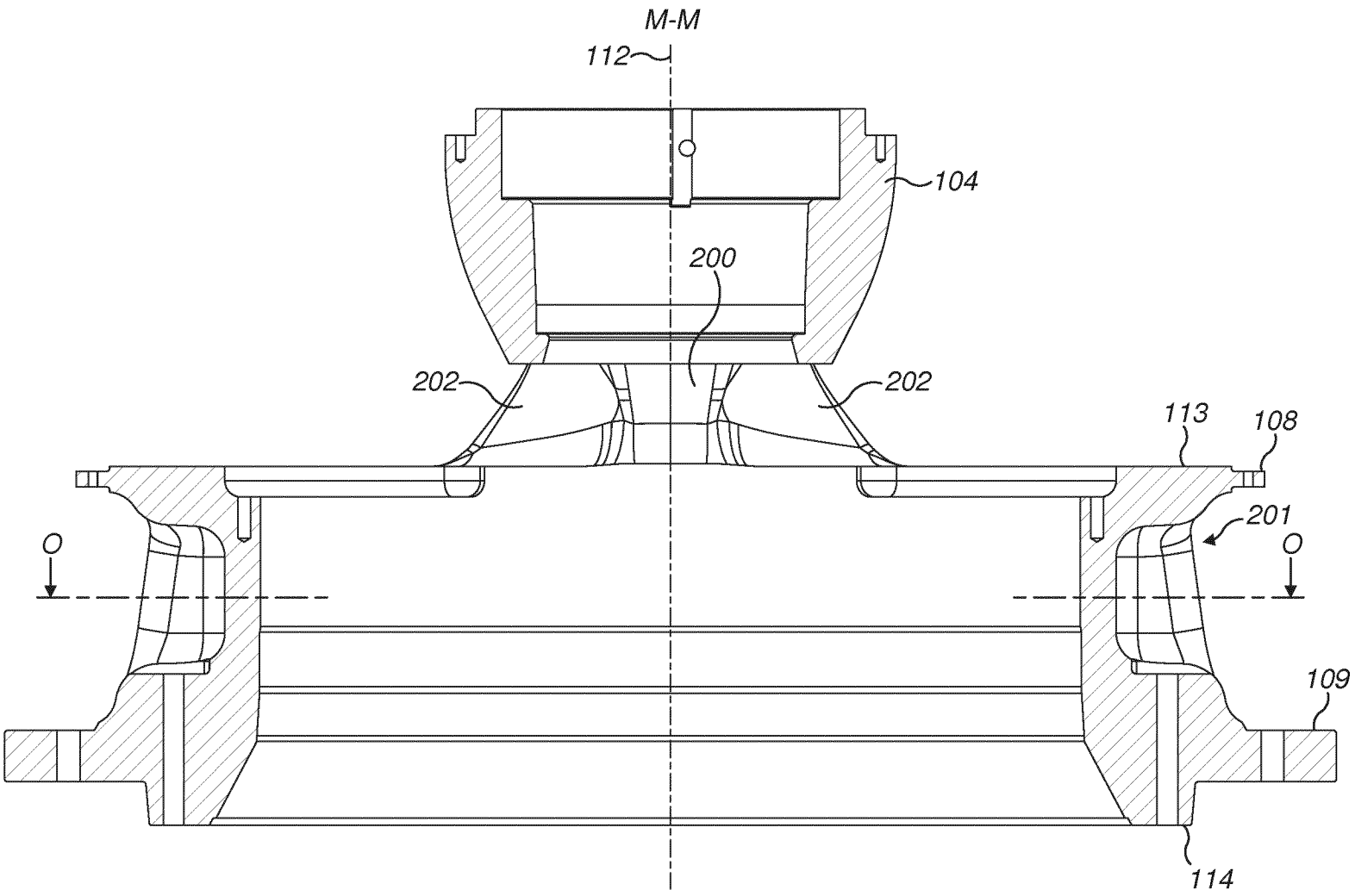
FIG. 3 is a side elevation cross sectional view through M-M of the topshell of FIG. 2.
Figure 4:
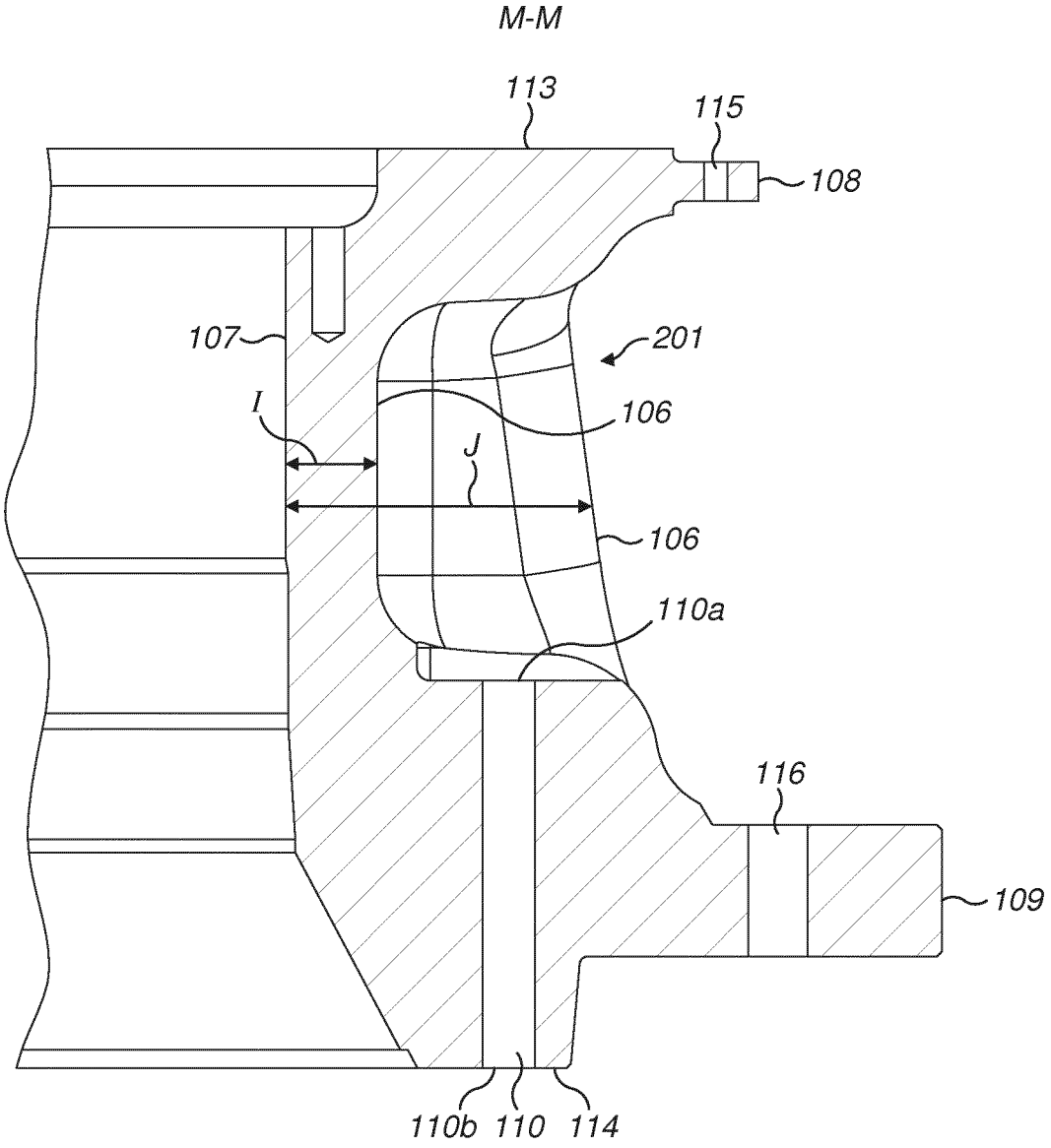
FIG. 4 is a magnified cross sectional view through M-M of the topshell of FIG. 1.
Figure 7:
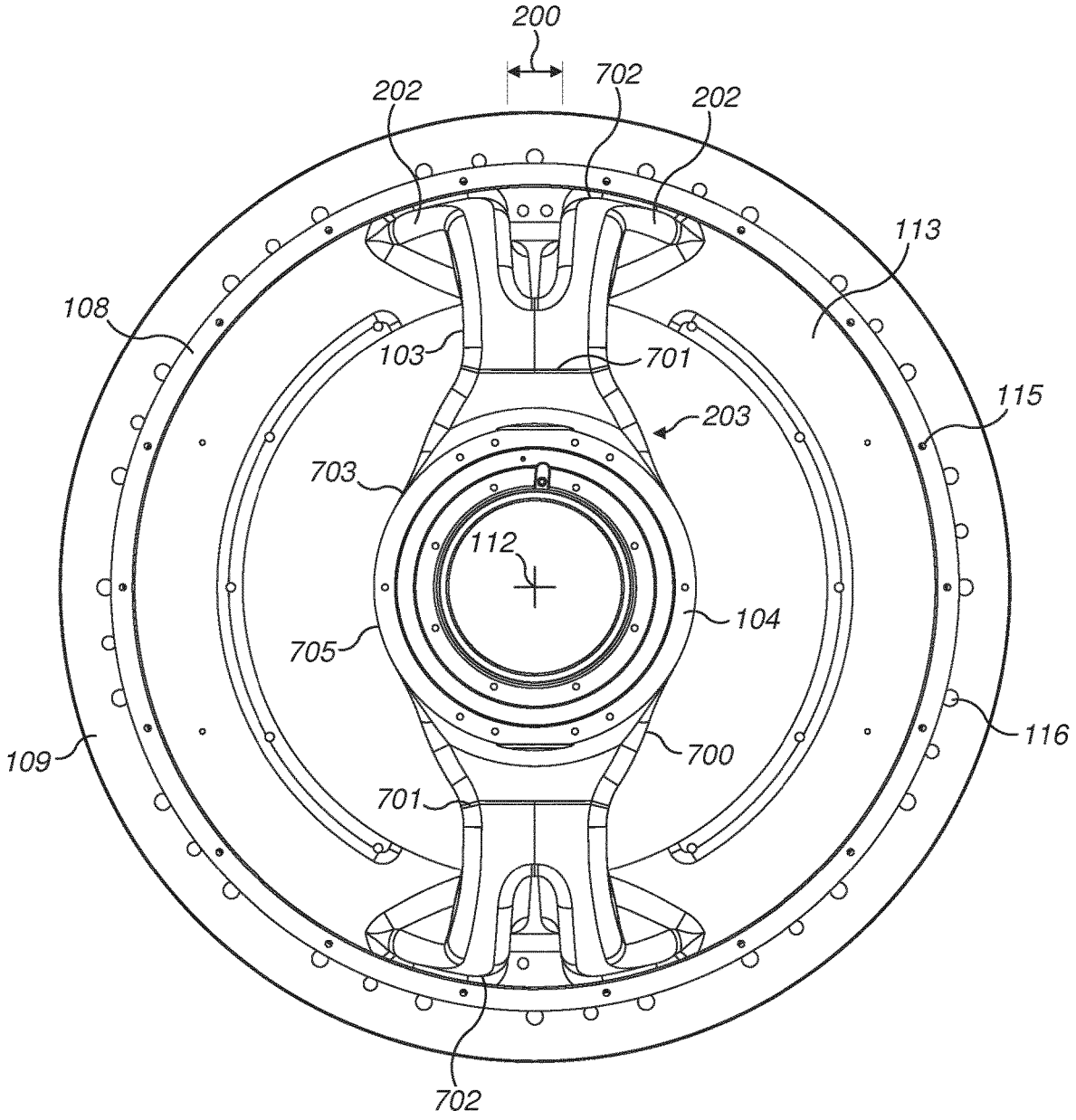
FIG. 7 is a plan view of the topshell of FIG. 2.

Referring to FIGS. 2, 3 and 7 each spider arm 103 comprises a transition region indicated generally by reference 203 that is located towards and at central hub 104. A width of each arm 103 in a plane perpendicular to axis 112 increases in a radial direction towards hub 104 from a minimum width position 701 (located approximately at a mid-radial length of arm 103). Additionally, a width (in the plane perpendicular to axis 112) of each arm increases in the generally axial direction at the junction with annular wall 102 (at the region of upper end annular face 113) via a pair of wings 202 that project outwardly in a circumferential direction from a central region 200 of each arm 103. Accordingly, each arm 103 is structurally reinforced at its radially inner and radially outer regions via each transition region 203 and the pair of wings 202. Such a configuration is advantageous to minimise stress concentrations within each arm 103 at the junction with hub 104 and topshell annular wall 102. To further optimise the topshell 100 to be resistant to stress concentrations resultant from loading forces encountered during use (including torsion, tensile and compressive forces) wall 102, at a position in a circumferential direction immediately below each arm 103, is devoid of a mount bore 110 and a accordingly a corresponding recess 201. That is, each diametrically opposed region of wall 102 at the positions axially below the radially outer regions of each arm 103 comprise a corresponding reinforced region 111 having a greater wall thickness. As has been noted from FIG. 2, the closest neighbouring mount bores 110 are positioned in a circumferential direction outside of the arm central region 200. Additionally, the closest mount bores 110 in circumferential direction (relative to each arm 103) are positioned outside of the region of each arm wing 202. As will be noted, each arm central region 200 corresponds to a region of each arm having a radially recessed portion relative to a radially outermost surface 702 of each arm 103 referring to FIG. 7. Accordingly, the recessed regions 201 and each corresponding mount bore 110 are distributed circumferentially at wall 102 so as to sit outside of the regions of each arm 103 to better distribute loading forces from spider 101 into the annular wall 102.

Figure 5:
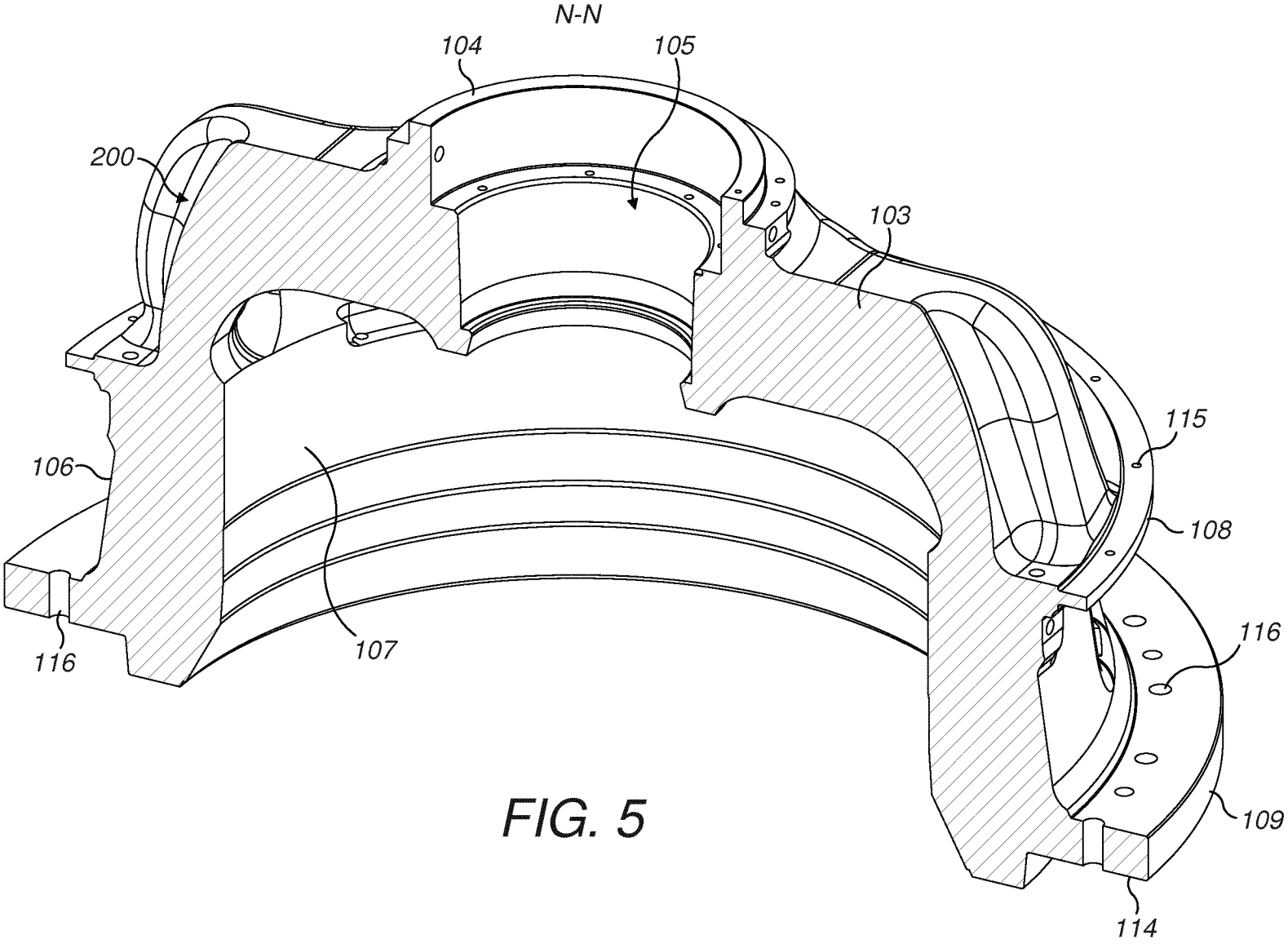
FIG. 5 is a perspective cross sectional view through N-N of the topshell of FIG. 1.

Referring to FIG. 5, a radial thickness of each arm 103 at an axial position immediately above upper annular flange 108 (at arm central region 200) is less than a corresponding radial thickness J of annular wall 102 immediately below (and at the same circumferential position) of each arm central portion 200. Accordingly, wall 102 is structurally reinforced at the diametrically opposed regions immediately and directly below the radially outer ends of each arm 103. Such a configuration is further advantageous to facilitate casting of the topshell 100. In particular, the location of the reinforced regions 111 relative to the position of the spider arms 103 facilitates the introduction of liquid cast material to avoid casting defects (in particular porosity in the final article) which otherwise reduce the operational lifetime of the topshell 100. The present configuration of annular wall 102 reduces further the complexity of the material feeders by simplifying the material flow-path from the lower annular surface 114 towards the uppermost annular rim 204 of hub 104 as the topshell is cast.

Figure 8:
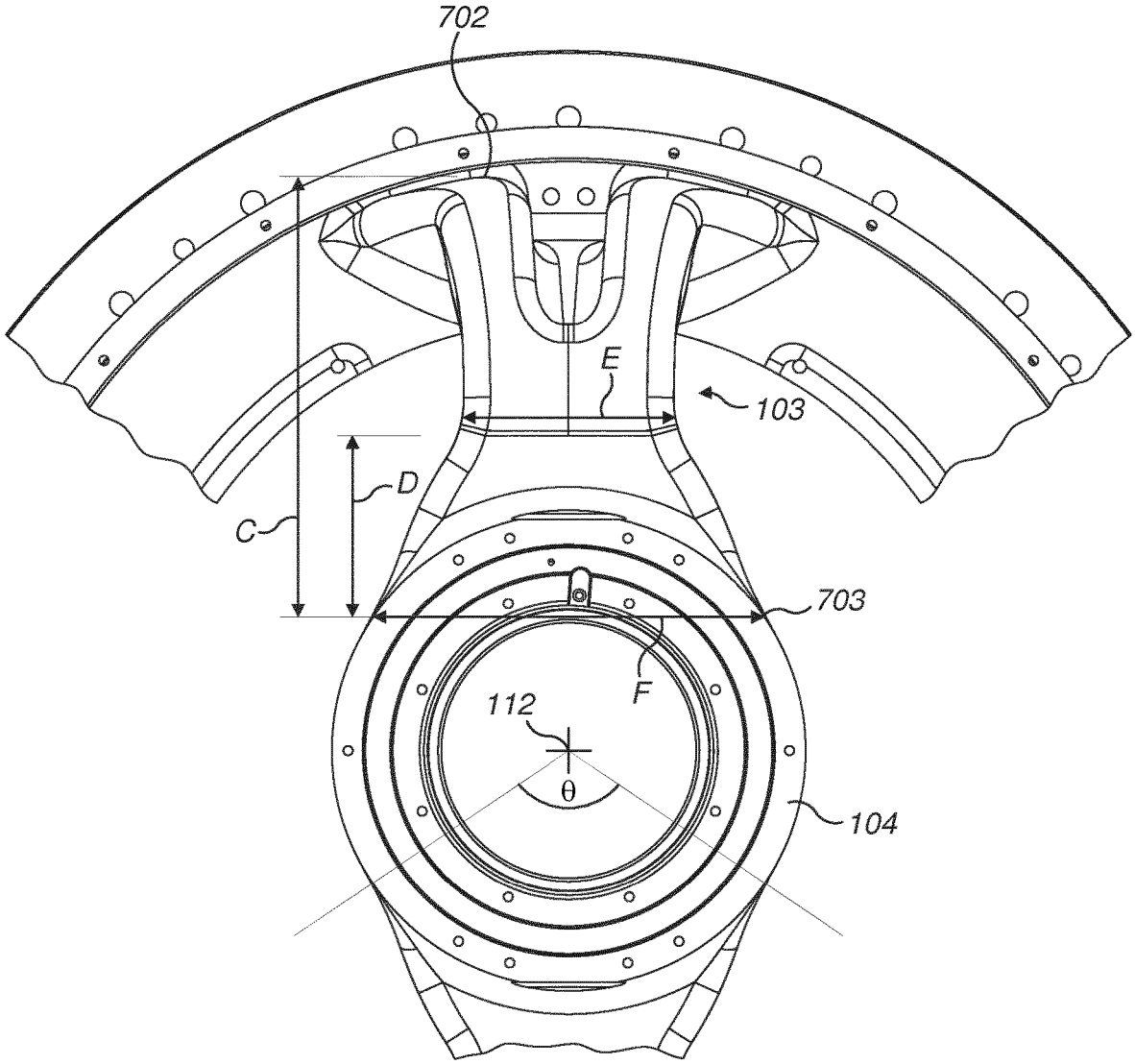
FIG. 8 is a magnified plan view of part of the topshell of FIG. 7.

Referring to FIGS. 7 and 8, the stress concentrations at topshell 100 are further minimised by the configuration of each transition region, indicated generally by reference 203, at the radially inner end of each arm 103 located at the junction with hub 104. As indicated, in a plane perpendicular to axis 112, a width of each arm 103 increases in a radial direction from a minimum width region 701 towards hub 104 along each transition regions 704. In particular, each arm 103 comprises a minimum width E (at region 701) located generally at a mid-radial length position of each arm 103 between a radially innermost end 703 (located at the junction with a radially outer surface 705 of hub 104) and a radially outermost surface 702 of each arm 103 (positioned immediately above and at the junction with upper end annular face 113). A corresponding width F of each arm 103 at the radially innermost end 703 is greater than the minimum width E. According to the specific implementation, width F is 80 to 95% greater than width E. As the transition region 704 flares outwardly in a circumferential direction, an enhanced cross sectional area of contact of each arm 103 with hub 104 is achieved so as to minimise stress concentrations and facilitate the transfer of loading forces generated by the rotating main shaft (not shown) accommodated within central bore 105. According to the specific implementation, an angular distance 8 over which each arm 103 extends and mates with the outer surface 705 of hub 104 is in a range 80 to 130° and in particular in a range 90 to 110°. Such a radial distance corresponds to the angular separation of end points 703 that represent the junction of the radially innermost end of each arm 103 and the radially outward facing surface 705 of hub 104. Additionally, a radial length D of each transitional region 203 is 40 to 60% of a total radial length C of each arm 103 as defined between the radial distance between radially innermost ends 703 and the radially outermost surface 702 of each arm 103.

To further optimise the enhanced strength characteristics of each arm 103, a shape profile of each transition region 203 in the plane perpendicular to axis 112 is generally convex according to the specific implementation. That is, a shape profile of the end faces of each arm 103 (that define the width of each arm 103 in the plane perpendicular to axis 112) is concave or tapered inwardly from a radially outer arm region towards the minimum width position 701. The shape profile 700 then changes to be convex from the minimum width positon 701 to the maximum width position 703. According to further specific implementations, the shape profile 700 may be a generally linear taper. However, the shape profile 700 is not concave which may otherwise reduce the strength characteristics and increase the likelihood of stress concentrations.

The invention claimed is:

1. A gyratory crusher topshell comprising:

an annular shell wall extending around a longitudinal axis, the wall having a radially outward facing surface, a radially inward facing surface, an axial upper annular end and an axial lower annular end for mating with a bottomshell;

a plurality of crushing shell mount bores extending axially through the wall towards the lower annular end to receive clamp bolts to mount a crusher shell within the topshell, wherein a radial thickness of the wall at reinforced regions extending in the circumferential direction between and at an axial position of an axial upper end of the mount bores is greater than a radial thickness of the annular wall at a position of each mount bore in the circumferential direction; and a spider having arms extending radially outward from a boss positioned at the longitudinal axis extending through the topshell, to the axial upper annular end of the wall, wherein the mount bores are distributed in a circumferential direction around the wall and being positioned at regions not axially below a central region in the circumferential direction of a radially outer end of each of the spider arms, wherein a width of each of the spider arms in a plane perpendicular to the longitudinal axis and in a radially inward direction increases at respective transition regions of connection with the hub, wherein a shape of the transition regions in the plane perpendicular to the longitudinal axis is a linear taper or is convex and the transition regions terminate at an outward facing surface of the hub.

2. The topshell as claimed in claim 1, wherein each of the spider arms include a pair of wings that project outwardly in the circumferential direction at a region where the spider arms meet the upper annular end, the mount bores being positioned at regions not axially below the central region and the wings of the arms.

3. The topshell as claimed in claim 1, wherein the mount bores are positioned in a circumferential direction not axially below any portion of the spider arms.

4. The topshell as claimed in claim 1, wherein the reinforced regions extend axially at least between the axial upper ends of the mount bores and an axial region immediately below the upper annular end of the wall.

5. The topshell as claimed in claim 1, wherein the outward facing surface at the reinforced regions of the wall in a circumferential direction between the mount bores is positioned radially outside a radial position of each of the mount bores.

6. The topshell as claimed in claim 1, wherein the wall includes a generally uniform radial thickness that is interrupted in a circumferential direction by radially recessed regions centred respectively on each of the mount bores, wherein a wall thickness at the recessed regions is less than a wall thickness at the reinforced regions between the mount bores in a circumferential direction.

7. The topshell as claimed in claim 1, further comprising an upper annular flange projecting radially outward from the outward facing surface of the wall at an axial position towards the upper annular end, and a lower annular flange projecting radially outward from the outward facing surface of the wall at an axial position towards the lower annular end, the lower annular flange including a plurality of bottomshell attachment bores, the attachment bores being positioned radially outside the crushing shell mount bores, wherein the reinforced regions extend axially between the upper annular flange and the lower annular flange.

8. The topshell as claimed in claim 1, wherein a width of each of the spider arms via each respective transition region increases continuously in the radially inward direction from a minimum width of each spider arm along a radial length portion of each spider arm, wherein said length portion is in the range 30 to 70% of a total radial length of each spider arm as defined between a radially outermost surface of each spider arm positioned at the annular upper end of the wall and a radially innermost end of each arm corresponding to a radially innermost part of the respective transition region that interfaces with the radially outward facing surface of the hub.

9. The topshell as claimed in claim 8, wherein the range is 40 to 60%.

10. The topshell as claimed in claim 8, wherein a maximum width of each spider arm at a radially inner end of each transition region that interfaces with the radially outward facing surface of the hub is in the range 60 to 100% greater than the minimum width of each arm in the plane perpendicular to the longitudinal axis.

11. The topshell as claimed in claim 10, wherein the range is 80 to 95%.

12. The topshell as claimed in claim 1, wherein each of the transition regions interface with the hub in the plane perpendicular to the longitudinal axis over an annular distance in a range 80 to 130°.

13. A gyratory crusher comprising a topshell according to claim 1.

* * * * *